United States Patent [19]

Dittrich

[11] Patent Number: 4,557,828

[45] Date of Patent: Dec. 10, 1985

[54] METHOD IN THE OPERATION OF MAGNETIC SEPARATORS

[75] Inventor: Vital Dittrich, Sala, Sweden

[73] Assignee: Sala International AB, Sala, Sweden

[21] Appl. No.: 444,052

[22] Filed: Nov. 22, 1982

[30] Foreign Application Priority Data

Nov. 30, 1981 [SE] Sweden ..... 817151

[51] Int. Cl.[4] ..... B03C 1/02

[52] U.S. Cl. ..... 209/214; 209/232; 210/222; 277/3; 277/237 R

[58] Field of Search ..... 210/222, 223; 209/223, 209/222, 223 A, 223 R, 232, 227, 214; 414/217; 34/242; 277/237 R, 3, 135, 236

[56] References Cited

U.S. PATENT DOCUMENTS

| | | | |
|---|---|---|---|
| 3,326,374 | 6/1967 | Jones | 209/214 |
| 3,375,925 | 10/1966 | Carpenter | 209/222 |
| 3,849,301 | 11/1974 | Reading | 209/232 |
| 3,920,543 | 3/1973 | Marston | 209/222 |
| 4,052,316 | 10/1977 | Nolan | 210/222 |
| 4,059,510 | 11/1977 | Reading | 209/233 A |
| 4,191,591 | 3/1980 | Bender | 209/232 |
| 4,204,948 | 5/1980 | Wechsler et al. | 209/233.1 |
| 4,208,277 | 6/1980 | Lofthouse | 209/223 A |
| 4,342,447 | 8/1982 | Marx | 277/3 |

*Primary Examiner*—Frank W. Lutter
*Assistant Examiner*—William Bond
*Attorney, Agent, or Firm*—Arthur M. Streich; Timothy R. Conrad

[57] ABSTRACT

This invention relates to a method in the operation of magnetic separators comprising a plurality of canisters or like devices (4) containing magnetizable induction poles (41) arranged to pass through a magnetic field (1). While the canisters (4) are located in the magnetic field (1), a particle suspension is supplied (5) to the canisters, in which magnetizable particles are attracted to the induction poles (41). Rinsing fluid (6) may optionally be supplied to the canisters while the canisters are still located within the magnetic field (1), thereby to remove non-magnetic particles through discharge means (*7a, 7b*) for fluid and non-magnetic material. Outside the magnetic field flushing fluid is supplied in a flushing station (8, 56), this flushing fluid removing magnetic material through discharge means (8, 57) for magnetic material. The canisters (4) are provided with flexible sealing lips (36) as disclosed in U.S. Pat. No. 4,052,310, which bend to present a convex side (47) in sliding sealing engagement with adjacent structures (37, 38). In accordance with this invention, flushing fluid is supplied beneath canisters (4) and drawn upwardly therethrough by a suction pump (60) to provide a lower pressure on the convex side (47) of sealing lips (36) between the rinse station (6) and the flush station (8), than is applied to oppositely facing concave sides (48) of the sealing lips, to provide a resultant force acting upon the concave side (48) which forces such sealing lips into effective sealing engagement against the adjacent structure (37, 38).

3 Claims, 2 Drawing Figures

METHOD IN THE OPERATION OF MAGNETIC SEPARATORS

Figure 1:
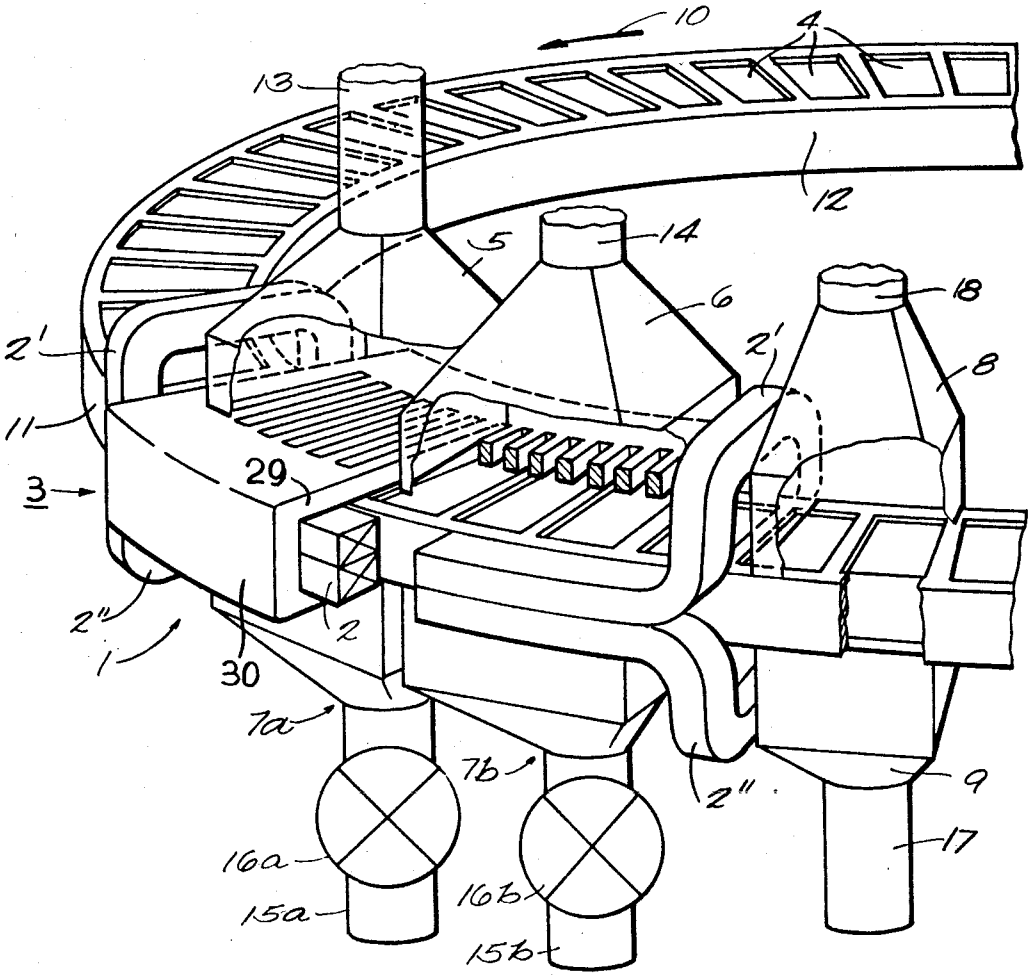

The present invention relates to a method in the operation of magnetic separators of the kind which comprise a plurality of sequentially arranged canisters or other holding means for induction poles of magnetizable material, including inlet and outlet openings for material and fluid; path means for the canisters, which are arranged to pass through a magnetic field; means for supplying material suspended in a fluid to said canisters when said canisters are located in the magnetic field; optional means for supplying a rinsing fluid to the canisters subsequent to said canisters having passed said material supply means and while still being located in said magnetic field; at least one discharge means for discharging fluid and material not attracted to the induction poles when said material and fluid depart through the outlets of said canisters while said canisters are located in said magnetic field; and at least one flushing means having flushing-fluid supply means located outside said magnetic field, said flushing fluid being arranged to flush magnetizable material attracted to the induction poles through magnetic-material discharge means; and sealing means for fluid flows from and/or to said canisters and at least one of said supply means for the material suspension, rinsing fluid, flushing fluid and/or corresponding discharge means.

Examples of such magnetic separators are described, inter alia, in U.S. Pat. Nos. 3,920,534; 4,052,310; 3,935,095; 3,375,925; 4,066,537; 3,326,374; 4,059,510 and 4,191,591. Not all of these previously known magnetic separators are necessarily provided with sealing means of the aforementioned kind. It is possible, however, to provide such separators with seals, and hence the method according to the invention can be advantageously applied thereto.

The sealing means comprise a stationary section which forms part of the surfaces defining the canister movement path, and movable sections which form or are connected to the end surfaces of the canister walls. The movable sealing means are arranged in the movement direction of said path and transversely thereto. Normally, at least one of the stationary and one of the movable sealing means is made of a resilient material, and may comprise, for example, rubber lips.

It has been found, however, that these sealing means are not sufficiently effective, so that part flows of fluid and material move in unintended directions, so that magnetic and nonmagnetic material becomes unintentionally mixed in the wrong end product.

The reason for this sealing deficiency is as follows: when a sealing device made of resilient material, for example, a rubber lip, comes into contact with the other, cooperating sealing surface it is deformed and/or deflected, optionally with the aid of guide surfaces, and lies against the opposing, fixed sealing surface (i.e. a sealing surface made of a non-resilient material or a material of insignificant resilience) since the resilient sealing device strives to return to its original form. When the pressure on one side of a rubber lip of such sealing devices is greater than the pressure on the other side of said lip, the sealing effect will vary in dependence upon on which side of the lip the highest pressure prevails. If the rubber lip has deflected from a space or chamber of higher pressure towards a space or chamber of lower pressure, the rubber lip will deflect still further when the pressure differential is sufficiently great, and allow a part flow of fluid to pass to the chamber or space of lower pressure. On the other hand, if the higher pressure is on the side towards which the rubber lip is deflected, said lip will be urged against the opposing sealing surface, thereby improving the seal. Thus, such a rubber lip seal has a generally convex sealing side and an oppositely facing concave side. Consequently, the transverse seals between two mutually sequential canisters will allow fluid to pass in one direction and seal against such passage of fluid in the other direction when there is a sufficiently high pressure differential acting against the concave side to push the seal against the opposing sealing surface.

Sealing devices are also found which comprise comparatively wide resilient sealing strips instead of resilient lips. These strips are not deflected, but merely pressed together against a further sealing surface, which is normally fixedly arranged. The aforementioned sealing effect is not obtained in this case. On the other hand, the sealing strips may be worn by the particles of material with which they come into contact, so as to create a slot between sealing strip and said other sealing surface. If this slot is located on the side on which the higher pressure prevails, and if the pressure difference is sufficiently great, a part flow of fluid can be forced beyond the seal to the side of lower pressure, even when the slot does not fully penetrate the strip.

Seals are also known in which both of the sealing surfaces comprise non-resilient material, or material of insignificant resilience. Leakages will occur in such seals immediately they become worn, provided that there is a pressure difference across the seal.

The aforedescribed leakages can occur in both the longitudinally extending seals and the transversal seals. Leakage of fluid through the longitudinal seals is often not serious, provided that the fluid which leaks through said seals can be caused to disappear from the process and be separately recovered, and optionally returned to the process. Leakage through the transverse seals, however, can cause particles of material to depart from the process through unintended outlets.

When using transverse rubber-lip sealing devices, the main leakage direction depends upon whether the rubber lip comprises the stationary part of the seal or the movable parts thereof. When the rubber lips are stationary, they bend forwardly in the direction of movement, and any fluid which leaks passes substantially to the forward canister spaces. If the rubber lips are located on the partition walls of the canisters, said lips are deflected rearwardly in the direction of movement and any fluid which leaks will pass to rearwardly lying canister spaces. Thus, leakage will take place from the magnetic-material flushing station to possibly a rinsing station, material supply station, and from there to the area before the magnetic field, where a separate fluid filling station may be provided.

As will be understood from the foregoing, it has not been possible in the case of magnetic separators of the described kind to effectively control the leakage of fluid past the seals. One reason is that the input fluid, with or without material suspended therein, has a given pressure above ambient pressure. As a result of the resistance exhibited by the induction pole material to the flow of fluid there is created an overpressure, so as to enable a part flow of fluid to be forced beyond the sealing devices, particularly those sealing devices which extend transversely of the direction of movement of the path. The resilient sealing section or portion is normally arranged on the partition walls of the canisters, so that fluid leaks rearwardly of said movement direction. At locations adjacent the material supply means or the material supply station, this can result in a part flow of material supplied being forced into canisters which have not yet entered sufficiently far into the magnetic field for it to have achieved full strength. The induction poles at these locations are so weakly magnetized that the magnetic material is able to pass through the canisters without adhering to the induction poles. This means that magnetic material will mix with the nonmagnetic product, resulting in a decreased yield of magnetic material or in the nonmagnetic product being contaminated with magnetic material.

The problem of fluid part flows leaking past the seals can also occur at the flushing station. For example, when the goods are supplied vertically downwardly in the magnetic field, the magnetic goods will be released from the induction poles and begin to fall down into the space located between the underside of the canister and the lower stationary sealing surface when the canister has left the magnetic field. The inlet pressure of the flushing fluid is normally much higher than the inlet pressure of the material suspension and rinsing fluid. When the sealing means comprise seals of resilient material on the end surfaces of the canister walls, for example, rubber lips, the permeable side will be located in the flushing station. As beforementioned, when flushing fluid is supplied at high pressure, a part flow of said fluid will force the rubber lips on the partition walls of the canisters to move away rearwardly in the movement direction, into the magnetized space. Particularly in those cases where the flushing fluid is supplied in counterflow to prevent the canister from being blocked by oversize particles, a part flow of fluid will pass beneath the canisters from the flushing station to the magnetized space, said part flow entraining therewith magnetic particles which have fallen down into the space between the underside of the canister and the lower, stationary sealing surface. These magnetic particles will consequently be transferred to the discharge means for non-magnetic material and rinsing fluid. Magnetic particles can also be forced into the non-magnetic product when the flushing direction is the same as the material supply direction. This will be made more apparent hereinafter with reference to the accompanying drawings.

Consequently, an object of the present invention is to provide a method in the operation of magnetic separators for preventing the leakage of fluid and/or particles of material.

A further object of the present invention is to provide a method in the operation of magnetic separators of the type described for preventing leakage of fluid from the concave side of a transverse seal to the convex sealing side.

A still further object of the invention is to provide a method for effectively removing magnetic particles from the induction poles in a flushing station operating at relatively high pressure, without the occurrence of fluid leakages, either with or without material particles, to the canister chambers and discharge outlets upstream and/or downstream of the flushing station.

Another object of the invention is to reduce the total quantities of fluid passing through the magnetic separator.

To this end, the invention is mainly characterized by supplying flushing fluid beneath canisters in the flushing station and applying suction to a discharge line from above canisters in the discharge station, to provide a lower pressure on the convex side of flexible sealing lips located between the rinse station and the flush station, than is applied to the concave side of the lips, to thereby provide a resultant of force acting upon the concave sides of the sealing lips which forces the sealing lips into fluid sealing engagement against an opposing surface.

Figure 2:
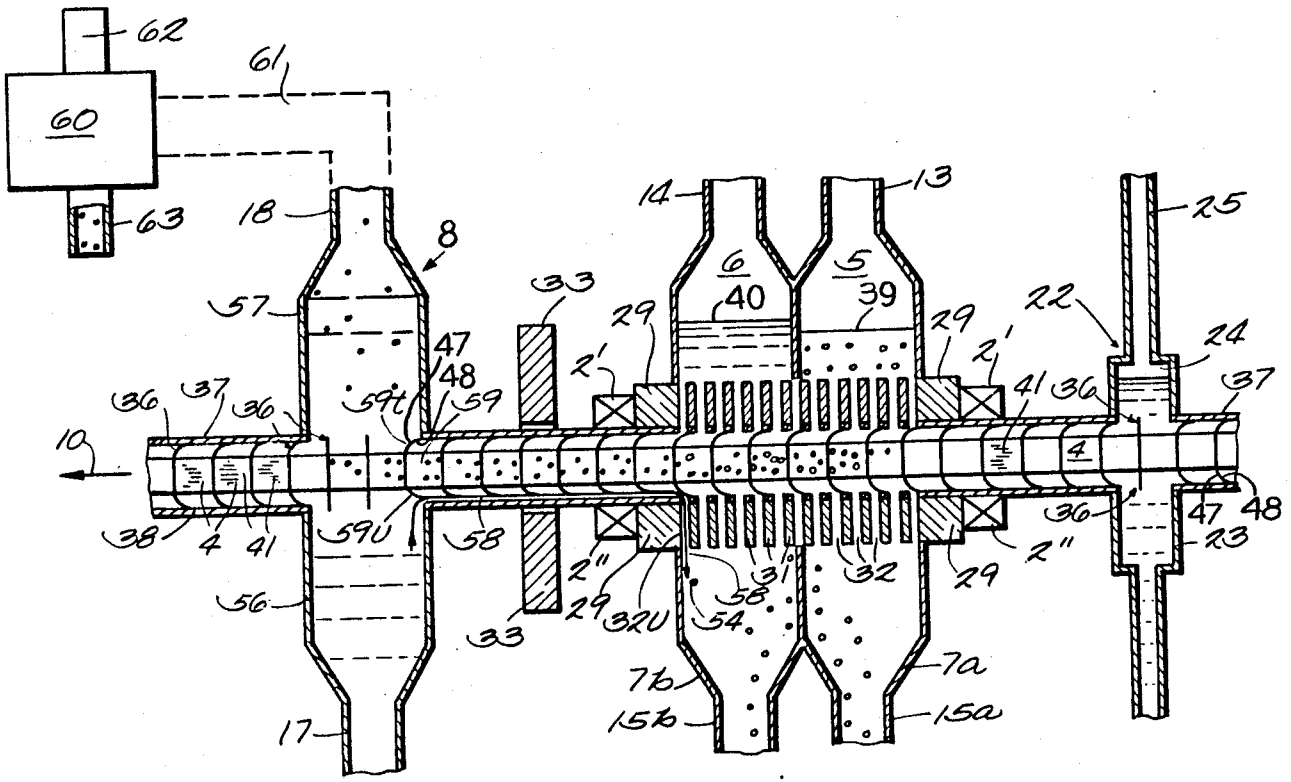

The invention will now be described in more detail with reference to the accompanying drawings, in which:

FIG. 1 is a partially cut-away view of a known moving matrix magnetic separator according to the present invention; and FIG. 2 is a vertical longitudinal sectional view of a moving matrix magnetic separator according to this invention, taken through the canisters.

The Figs. do not illustrate the various supporting frame structures required for magnetic heads, the various fluid supply and discharge lines and the circle of canisters with their support rings or other support structures. Neither do the drawings illustrate the bearings and drive means for the canisters or support structures therefor.

FIGS. 1 and 2 illustrate a moving matrix magnetic separator of the kind illustrated in U.S. Pat. No. 3,920,543, modified according to the present invention. The separator includes a magnetic head 1 having a separation chamber in which a powerful magnetic field is generated by a d.c. coil 2 surrounded by a magnetic yoke 3 which closes the outer magnetic field. The d.c. coil 2 has upwardly and downwardly extending end sections 2', 2'' which surround inlet and outlet openings communicating with said separation chamber. Passing through the separation chamber is a number of mutually sequential canisters 4 which are joined to form a ring and which carry magnetizable induction poles indicated generally by the number 41 and which may be as disclosed in the aforementioned U.S. Pat. No. 4,052,310. Located above coil sections 2', 2'' is a material-supply station 5 for accommodating a material-fluid suspension, the material in said suspension being arranged to pass through the canisters 4 while they are located in the magnetic field. Consequently, material having a relatively high magnetic susceptibility will be attracted to the induction poles 41 and retained on the surfaces thereof.

The illustrated magnetic separator also includes a rinsing station 6 for supplying rinsing fluid to the canisters 4 while they are still located within the magnetic field, thereby to rinse non-magnetic particles from the induction poles 41 before they leave the separation chamber in the magnetic head 1. Non-magnetic particles, suspension fluid, and rinsing fluid are led away from the magnetic head 1 through discharge means **7*a*, 7*b* for non-magnetic substances. The discharge means 7*a* is located below the material supply station 5, and leads away the non-magnetic material present in the suspension, together with fluid displaced by the incoming suspension. The discharge means 7*b* is located below the rinsing station 6 and conducts away residual non-magnetic suspension material together with rinsing fluid and particles of non-magnetic material entrained therewith, these particles having been temporarily held mechanically by magnetic material and the induction poles 41. When the canisters leave the magnetic field generated in the magnetic head, the induction poles are demagnetized together with the magnetic particles, which consequently cease to be attracted to one another, whereupon the canisters are moved to a flushing station 8. In the flushing station, the canisters are flushed with a fluid, wherewith magnetic particles are flushed from the canisters through a discharge line 9 for magnetic particles. The arrow 10 illustrates the direction in which the canisters move to carry induction poles 41 sequentially through the feed station 5, the rinse station 6 and then the flush station 8. As shown in FIG. 1, the canisters 4 are fixed in position by an outer ring 11 and an inner ring 12, said rings rotating with the canisters 4. As shown in both FIG. 1 and FIG. 2, the material supply station 5 is connected to an input line 13 for material suspension, and the rinsing station 6 is connected to an input line 14** for rinsing fluid. The discharge means *7a, 7b* are connected to discharge lines 15*a*, 15*b* for non-magnetic material and fluid. The discharge lines 15*a*, 15*b* may optionally be provided with valves 16*a*, 16*b* (as shown only in FIG. 1) or other devices for reducing the rate of flow of the fluid through the canisters, if so desired. The flushing station 8 is provided with a fluid input line 17, while the magnetic material discharge means 9 is provided with a discharge line 18 for magnetic material.

Externally of the magnetic head there is provided a forward filling station 22 provided with a fluid inlet 23, an air evacuation chamber 24 and an air venting pipe 25. The fluid supplied displaces practically all air as the canisters pass the filling station.

The magnetic yoke 3 shown in FIG. 1 is made from a ferromagnetic material and comprises sides 30 and forward and rear plates 29 which are best seen from FIG. 2. The yoke 3 includes portions 31 which define vertical slotted fluid passages 32. Referring again to FIG. 2, fluid and particles of material are able to pass through these passages, from the supply station and through the canisters to the discharge means *7a, 7b*. Between the upwardly and downwardly extending ends 2', 2'' of the d.c. coil and the flushing station 8 is provided a ferro-magnetic shield plate 33 which is arranged to close the magnetic flux on the outside of the coil 2', 2'', and therewith reduce losses, and to shield the flushing station from the influence of the coil. Thus, induction poles and magnetic particles are demagnetized in the flushing station, and will thus no longer be attracted to one another. The canisters 4 are guided through filling station 22, magnetic head 1 and flushing station 8 in the direction of movement indicated by arrow 10, by upper and lower canister enclosing structures 37, 38. As further shown in FIG. 2, the canisters 4 are provided with upper and lower flexible sealing lips 36, which may be made of rubber and arranged, as disclosed in the aforementioned U.S. Pat. No. 4,052,310, to bend lips 36 to present a convex side 47 in sliding sealing contact with the structures 37, 38, and present lips 36 with an oppositely facing concave side 48. When the canisters 4 pass from filling station 22 to and through flushing station 8, the resilient seals 36 will lie sealingly against upper and lower structures 37, 38.

With particular reference to FIG. 2, the apparatus has the following mode of operation. An empty canister arrives first at a filling station 22, when such is provided, and is there filled with fluid. The canister is then moved to the filling section 5, where material suspension is supplied through the passages 32. The material has been indicated with filled rings for magnetizable material and open rings for non-magnetizable material. In order to obtain sufficiently rapid flow through the canisters, the level of suspension in the material supply section 5 is held at such a height as to obtain a static pressure. Excessively rapid through-flow is counteracted by throttling of the valve 16*a* (shown only in FIG. 1). The rate of flow is most often adjusted by controlling both the valve 16*a* and the level of particle suspension 39. The induction poles 41 in the canister 4 have now been magnetized, and the magnetizable particles of material are also magnetized as they enter the canisters and are attracted to the induction poles. The non-magnetic material, on the other hand, passes straight through the canister and disappears through the lower through-flow passages 32. As the canister passes, more supply passages 32, more magnetic material is supplied from the filling section 5, this magnetic material being attracted to the induction poles. As the induction poles in the upper part of the canister become saturated with magnetic material, the magnetic material will move slowly downwardly in the canister before being attracted to an induction pole. If so much magnetic material is supplied that all induction poles become saturated, some of the magnetic particles, primarily those with the lowest magnetic susceptibility or half grains partially comprising non-magnetic material, will pass through the canister without being attracted to an induction pole. Consequently, it must be insured that the quantity of material supplied to a particular canister is not greater than its capacity to retain magnetic material. The canister then passes to the rinsing section 6 of the magnetic head, where rinsing fluid is supplied through passages 32. This rinsing fluid displaces residual material suspension from the canisters, and also removes any remaining non-magnetic particles which have been retained mechanically by induction poles and magnetic particles. In order for the rinsing operation to be fully effective, it is normally necessary to supply a greater volume of rinsing fluid than that required solely to displace the particle suspension from the canisters. It is also necessary in this case to regulate the flow rate, by maintaining a suitable inlet pressure, determined by the level 40 of rinsing fluid and suitable adjustment of the valves 16*a*, 16*b* (both shown only in FIG. 1).

The canisters are then moved out of the magnetic head 1, past the shield 33, which is made of ferro-magnetic material. When the canisters have passed the shield 33, the magnetic field ceases and therewith magnetization of the induction poles and the magnetic particles. These particles are then no longer attracted to one another. This takes place at the same time as the canisters enter the flushing station 8, where a powerful stream of flushing fluid is passed through the canisters, this flushing fluid flushing all magnetizable particles from the canisters. When a canister has left the flushing station 8, the upper and lower surfaces of the canister are in communication with atmosphere and the fluid drains from the canisters.

In accordance with the invention, undesired leakage flow indicated by arrow 58 in FIG. 2 can be prevented by causing discharge line 18 to communicate with a source of suction. Accordingly, in the FIG. 2 embodiment a schematically illustrated suction means 60 for magnetizable goods and flushing fluid is connected to the discharge lines 18 and the discharge means 57 by means of a connecting line 61 shown in broken lines. As a result of the suction effect promoted by the suction means the absolute pressure on the upper side of the canisters 4 will be lower than on their underside. Further, the suction effect will be so great that the absolute pressure will be lower on the convex side 47 of the seal 59*u* than on the opposite side 48. There are now no circumstances under which leakage flow 58 can form, and consequently no magnetizable material will be conveyed to the discharge means 7*b* for non-magnetic material.

The suction means 60 includes a gas separator (not shown), the gas being led away through a gas outlet 62. This gas mainly comprises air which has leaked from the surrounding atmosphere through side seals and the outlet end of the flushing station, where the convex sides 47 of the transverse seals 36 are directed towards the surrounding atmosphere, which has a higher absolute pressure. The suction means 60 is also provided with an outlet 63 for magnetizable material and flushing fluid.

As a result of the effect promoted by the suction means 60, there will be no counterpressure caused by the induction pole material in the canisters 4 at the flushing station 56, 57. This means that the liquid will flow more rapidly and therewith remove magnetizable particles and oversize particles more effectively. The effect of the suction means also creates different flow conditions in the canisters 4, which contribute to this increase in efficiency.

EXAMPLE 1

The invention will now be described in more detail with reference to a test carried out on a revolving type magnetic separator as shown in FIG. 2, that is the magnetic separator included a filling station 22 with upwardly directed flow, upstream of the magnetic field; material supply station 5 and rinsing station 6 with downwardly directed flow through the magnetic field; and a flushing station 8 with upwardly directed flow. The discharge line from the flushing station was connected to a centrifugal pump 60. The magnetic separator effectively treated a material containing hematite iron ore. The pump in the discharge line from the flushing station then broke down. As a result of this breakdown, the iron content of the non-magnetic product in the discharge means 7*b* from the magnetic separator increased, thereby demonstrating that without the application of suction, according to the present invention, to the upper flushing conduit 57, the undesired leakage indicated by arrow 58 does occur, and in the example such leakage occurred to an extent that the canisters were ultimately blocked. The induction poles were then changed for induction poles having larger through-flow openings, but even these became clogged with time. It was impossible to obtain satisfactory separation until the suction pump in the discharge line was restarted.

Upon completion of the test, the induction poles were cleaned, said poles comprising stacks of ferro-magnetic stainless steel, expanded-metal nets with intermediate spacer wires of non-magnetic stainless material. The induction poles were cleaned by lowering one stack of poles at a time into a water bath and vibrating the whole arrangement for thirty minutes. 60 kg of material were removed from the induction poles in this manner. After the poles had been cleaned, they were reinstalled in the magnetic separator. The discharge line from the flushing station was then connected to a vacuum station comprising a liquid-separator vessel, vacuum pump and a pump for separated liquid. The magnetic separator was started and solely water was supplied to all inlets. The underpressure in the vacuum station was set to an underpressure of 0.2 atmosphere. This resulted in the removal of a further 15 kg material from the induction poles.

EXAMPLE 2

Another test was carried out under operating conditions using the same magnetic separator as that described in Example 1. The induction poles comprised a fine-mesh, ferro-magnetic stainless extended-metal net, and the treated material comprised finely-ground mineral particles. Magnetizable material was flushed away with fluid moving upwardly in counterflow to the material-supply direction, in a double flushing station. At least the discharge line from the first flushing station, in the direction of movement, was connected to a vacuum station of the same kind as that referred to in Example 1, and, at times, both discharge lines were connected. The test was carried out continuously for a total of twenty-eight hour shifts, there being maintained an underpressure of 1–2 m water column. Upon completion of the test, the canisters were inspected and found to be free of material adhering to the surfaces thereof, and neither were the expanded-metal nets clogged. Subsequent to making this inspection, the maagnetic separator was restarted without connecting the discharge lines from the flushing station to the vacuum pump. The problem of particles clogging the expanded-metal nets and blocking the canisters was quickly encountered thus, further demonstrating that without suction applied according to this invention, a leakage of flush fluid carrying magnetizable particles occurs along the path indicated by line 58 which overloads canisters with such material and results in the aforesaid clogging.

The described embodiment is not limitative of the invention, but can be modified within the scope of the claims.

The embodiments of the invention in which an exclusive property or privilege is claimed are defined as follows:

1. A method of operating magnetic separators of the kind having a plurality of sequentially arranged adjacent canisters (4) containing a magnetizable matrix of induction poles (41) and having upper and lower openings for flow therethrough of a fluid to be cleaned of material contained therein; upper and lower canister enclosing and path defining structures (37, 38) arranged, respectively, above and beneath the canisters (4) and defining a path through which said canisters (4) pass through a magnetic field within a coil (2) and a yoke (3) which surround portions of said structures (37, 38) with portions (31) of the yoke (3) and portions of said structures (37, 38) defining passages (32) therethrough; longitudinal and transverse flexible sealing lips 36 secured along upper and lower edges of said canisters (4) and making sliding sealing contact with the enclosing structures (37, 38) to bend each transverse seal lip (36) into a convex-concave configuration where adjacent canasters are separated by a common transverse seal lip; a feed station (5) and a rinse station (6) sequentially arranged within the magnetic field with fluid inlets (13, 14) above canisters (4) for passing the fluid to be cleaned and then a rinse fluid both downwardly through the passages (32) and canisters (4); and a flush station (8) spaced away from the magnetic field, with the flushing station (8) having a first flushing conduit (56) beneath the lower enclosing structure (38) and a second flushing conduit (57) above the upper enclosing structure (37), and with said conduits (56, 57) and structures (37, 38) defining a flushing fluid passage to and from a canister (4) in the flushing station (8); the method comprising the steps of:

(a) transporting said canisters (4) sequentially through said feed station (5) and passing fluid to be cleaned downwardly into said canisters (4), and through said rinse station (6) and passing a rinse fluid downwardly into said canisters and through flush station (8) and thereby bend each said transverse sealing lip (36) approaching the flush station (8) to present a convex side (47) thereof facing the flush station (8) and an oppositely facing concave side (48);

(b) regulating a rinse fluid level spaced above the canisters (4) to apply fluid pressure to the concave side (48) of transverse sealing lips (36) between the rinse station (6) and flush station (8) to thereby press each such sealing lip (36) against adjacent enclosing structure (37, 38);

(c) supplying flushing fluid to said first flushing conduit (56) beneath the lower enclosing structure (38); and (d) drawing a suction on the second flushing conduit (57) above the upper enclosing structure (37) to draw fluid upwardly from said canisters (4) and to provide a lower pressure on the convex side of said transverse sealing lips (36) between rinse station (6) and flush station (8) than is being applied on the concave side of each of such transverse sealing lips (36) to thereby provide a resultant of force acting upon the concave sides of such transverse sealing lips (36) which forces such sealing lips (36) into fluid sealing engagement against the adjacent enclosing structure (37, 38).

2. A method according to claim 1 in which the suction drawn on the second flushing conduit (57) is of subatmospheric pressure.

3. A method according to claim 2 in which the suction drawn on the second flushing conduit (57) is at approximately an under pressure of 0.2 atmosphere.

* * * * *